US005829498A

United States Patent [19]

Liao

[11] Patent Number: 5,829,498

[45] Date of Patent: Nov. 3, 1998

[54] WOOD PLANING MACHINE

[76] Inventor: Juei-Seng Liao, No. 295, Nan-King E. Rd., Taichung City, Taiwan

[21] Appl. No.: 893,574

[22] Filed: Jul. 10, 1997

[51] Int. Cl.[6] ..... B27C 1/02; B27C 1/14

[52] U.S. Cl. ..... 144/117.1; 144/130

[58] Field of Search ..... 144/114.1, 116, 144/117.1, 117.2, 129, 130

[56] References Cited

U.S. PATENT DOCUMENTS

| | | | |
|---|---|---|---|
| 2,577,975 | 12/1951 | Moore | 144/130 UX |
| 2,780,251 | 2/1957 | Williams | 144/130 |
| 4,436,126 | 3/1984 | Lawson | 144/130 |
| 4,440,294 | 4/1984 | Bartlett | 144/130 |
| 4,456,042 | 6/1984 | Clark et al. | 144/117.1 |
| 5,176,190 | 1/1993 | Miyamoto et al. | 144/117.1 |
| 5,725,035 | 3/1998 | Shadeck | 144/130 X |

*Primary Examiner*—W. Donald Bray

*Attorney, Agent, or Firm*—Christie, Parker & Hale, LLP

[57] ABSTRACT

A wood planing machine includes a machine base having a bed, a pair of upright threaded rods mounted rotatably on opposite end portions of the bed, and a pair of vertical side walls mounted on the opposite end portions of the bed. The side walls are formed with front and rear pairs of aligned vertically extending slots. An upper housing is disposed between the side walls above the bed, and has front and rear portions provided respectively with an opposite pair of slide pieces which engage a corresponding one of the front and rear pairs of vertically extending slots to mount slidably the upper housing on the side walls. The upper housing further has opposite end portions formed with a pair of vertically extending screw holes. The threaded rods extend threadedly and respectively through the screw holes and are rotatable on the bed so as to raise or lower the upper housing to a desired position. Cutting and feed rollers are mounted rotatably on the upper housing and are rotatable about parallel horizontal axes.

5 Claims, 5 Drawing Sheets

WOOD PLANING MACHINE

BACKGROUND OF THE INVENTION

1. Field of the Invention

The invention relates to a wood planing machine, more particularly to one having a durable construction.

2. Description of the Related Art

Referring to FIGS. 1 and 2, a conventional wood planing machine is shown to comprise a machine base 10 having a bed 100 over which a wooden work piece (not shown) passes, and an upper housing 11 above the bed 100. A cutting roller 12 is mounted on the upper housing 11 and is rotatable about a horizontal axis. Front and rear feed rollers 13, 14 are similarly mounted on front and rear portions of the upper housing 11 and are rotatable about axes parallel to the cutting roller 12. A motor 15 is mounted on the upper housing 11 and is coupled to one end of the cutting roller 12 so as to drive rotatably the same. The other end of the cutting roller 12 is coupled to the feed rollers 13, 14 such that the feed rollers 13, 14 rotate simultaneously with the cutting roller 12.

The upper housing 11 has opposite end portions formed with a pair of vertically extending screw holes 111. The machine base 10 has a pair of upright threaded rods 16, 17 mounted rotatably on the bed 100 and extending threadedly and respectively through the screw holes 111. An adjusting handle 18 is mounted on one end of one of the threaded rods 16 and is operable so as to rotate the latter on the bed 100. The threaded rods 16, 17 are coupled to each other such that rotation of one of the threaded rods 16 results in simultaneous rotation of the other one of the threaded rods 17. The opposite end portions of the upper housing 11 are further formed with four vertically extending bores 112. The machine base 10 further has four pillars 19 extending upwardly from the bed 100 and slidably through the bores 112. As such, the upper housing 11 can be raised or lowered relative to the bed 100 when the threaded rods 16, 17 rotate due to operation of the adjusting handle 18, thereby permitting adjustment of the height of the cutting roller 12 in accordance with the desired thickness of the finished product.

The drawbacks of the aforementioned wood planing machine are as follows:

1. The upper housing 11 can be positioned at a desired height on the machine base 10 due to the threaded engagement thereof with the threaded rods 16, 17. When the wood planing machine is in operation, the upper housing 11 is subjected to vertical forces which are applied to the threaded engagement between the threaded rods 16, 17 and the upper housing 11, thereby resulting in the possibility of damage to the screw threads on the threaded rods 16, 17 or in the screw holes 111.
2. The bores 112 in the upper housing 11 must match the pillars 19 on the bed 100 so as to ensure smooth sliding movement of the upper housing 11 on the pillars 19. However, when the wood planing machine is in operation, the upper housing 11 may be subjected to uneven lateral forces which are transmitted to the pillars 19. As such, bending of the pillars 19 may result to prevent future adjustment of the height of the cutting roller 12.

SUMMARY OF THE INVENTION

Therefore, the object of the present invention is to provide a wood planing machine which is more durable as compared to the aforementioned prior art.

Accordingly, the wood planing machine of this invention comprises:

a machine base having a bed with opposite end portions, a pair of upright threaded rods mounted rotatably on the opposite end portions of the bed, and a pair of vertical side walls mounted on the opposite end portions of the bed, the side walls being formed with front and rear pairs of aligned vertically extending slots;

an upper housing disposed between the side walls above the bed, the upper housing having front and rear portions provided respectively with an opposite pair of slide pieces which engage a corresponding one of the front and rear pairs of vertically extending slots to mount slidably the upper housing on the side walls, the upper housing further having opposite end portions formed with a pair of vertically extending screw holes, the threaded rods extending threadedly and respectively through the screw holes and being rotatable on the bed so as to raise or lower the upper housing to a desired position relative to the bed; and cutting and feed rollers mounted rotatably on the upper housing and rotatable about parallel horizontal axes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
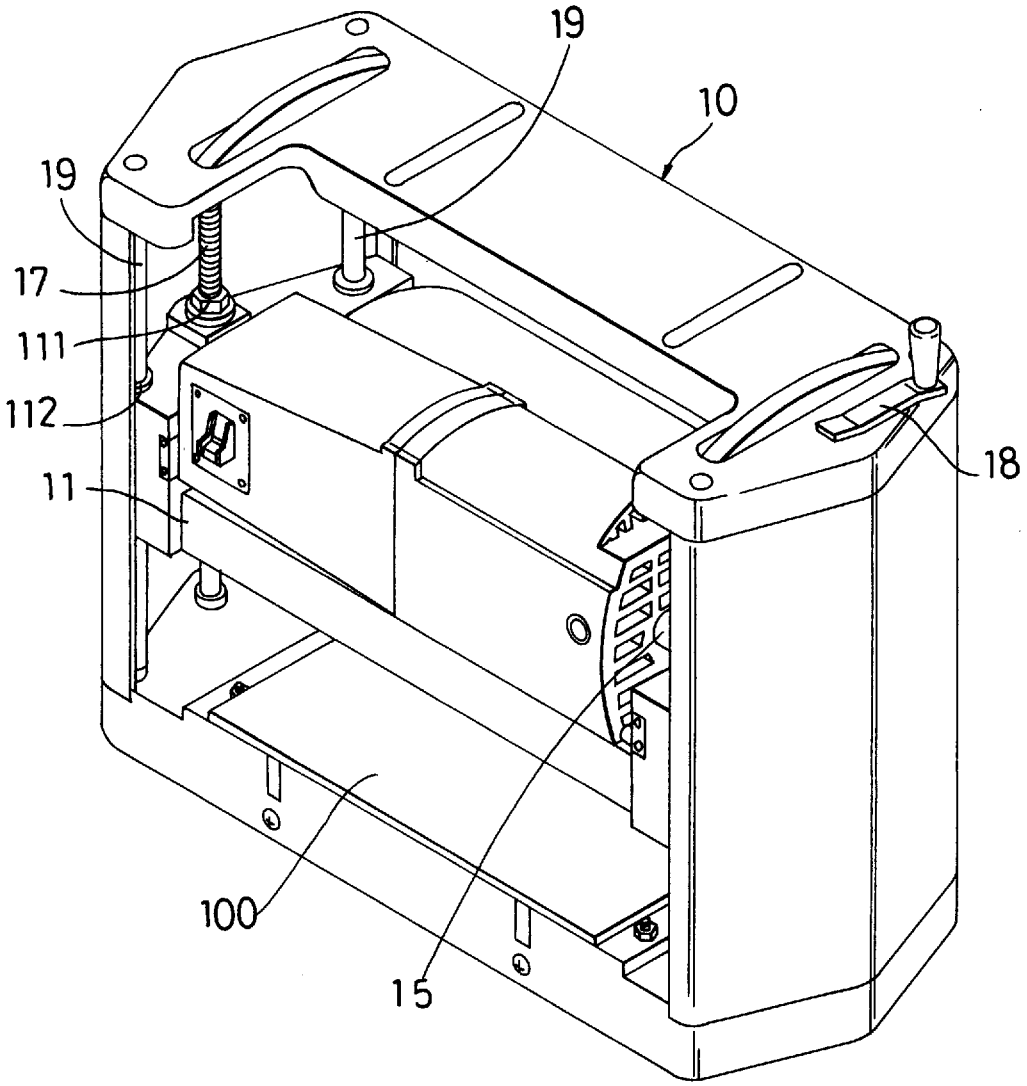
FIG. 1 PRIOR ART
FIG. 1 is a perspective view of a wood planing machine in the prior art.
Figure 2:
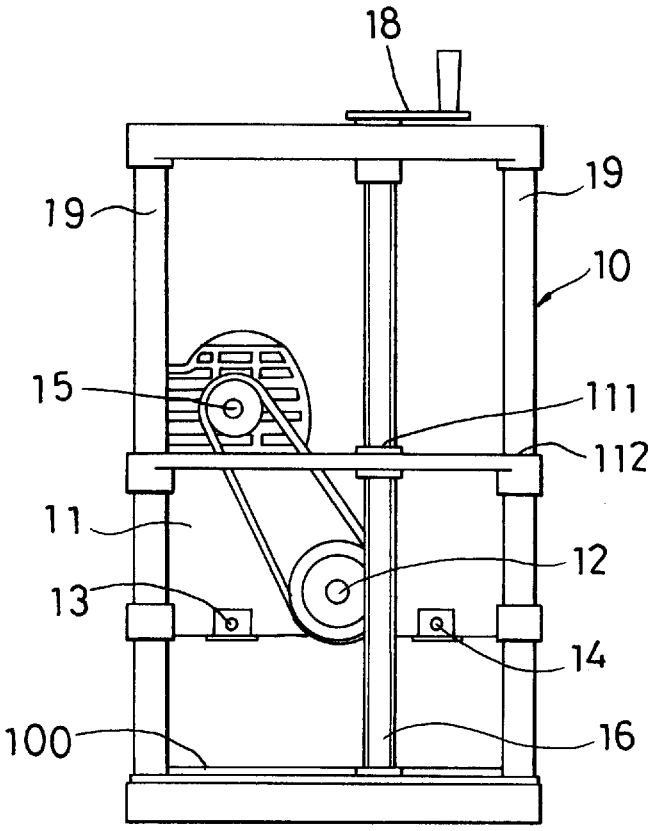
FIG. 2 PRIOR ART
FIG. 2 is a schematic side view of the wood planing machine of FIG. 1.
Figure 3:
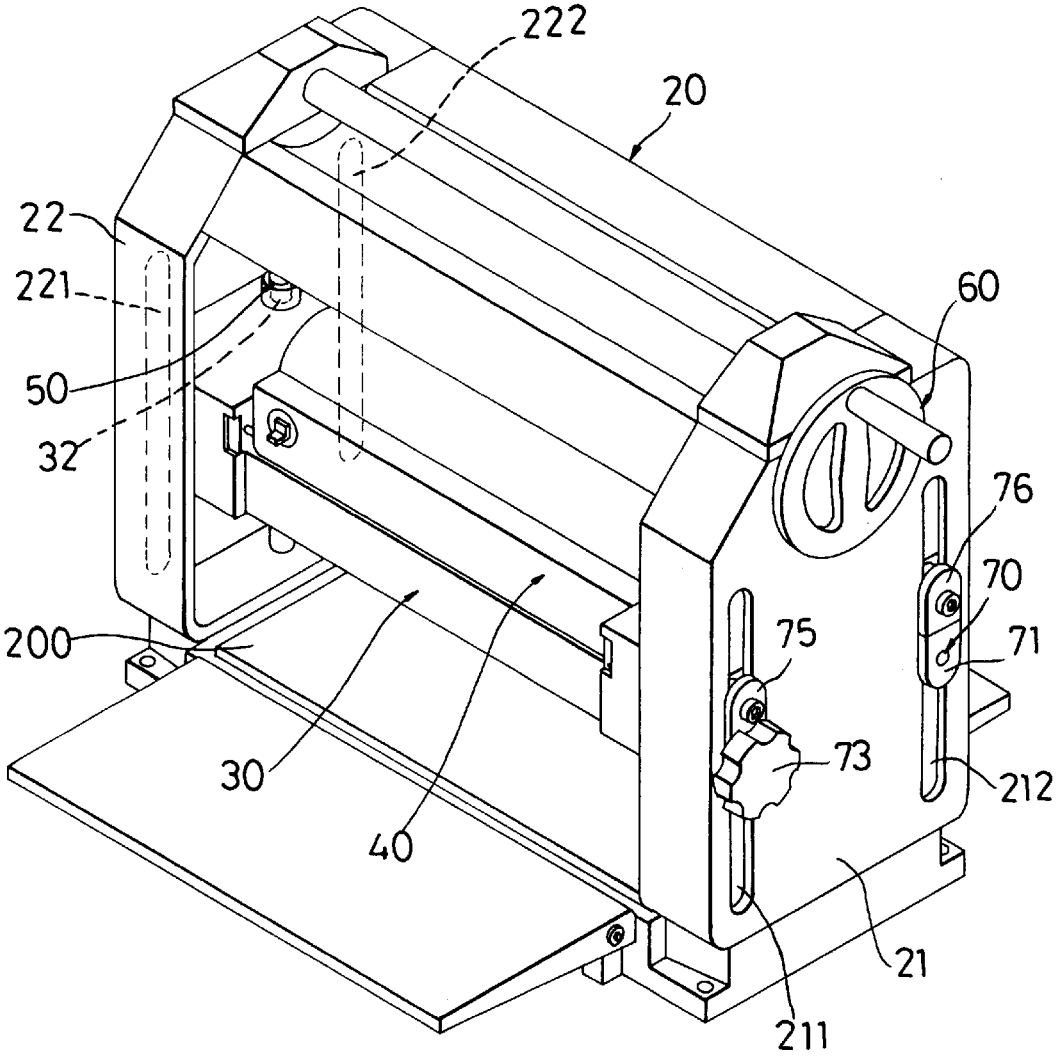
FIG. 3 is a perspective view of the preferred embodiment of a wood planing machine according to the present invention.
Figure 4:
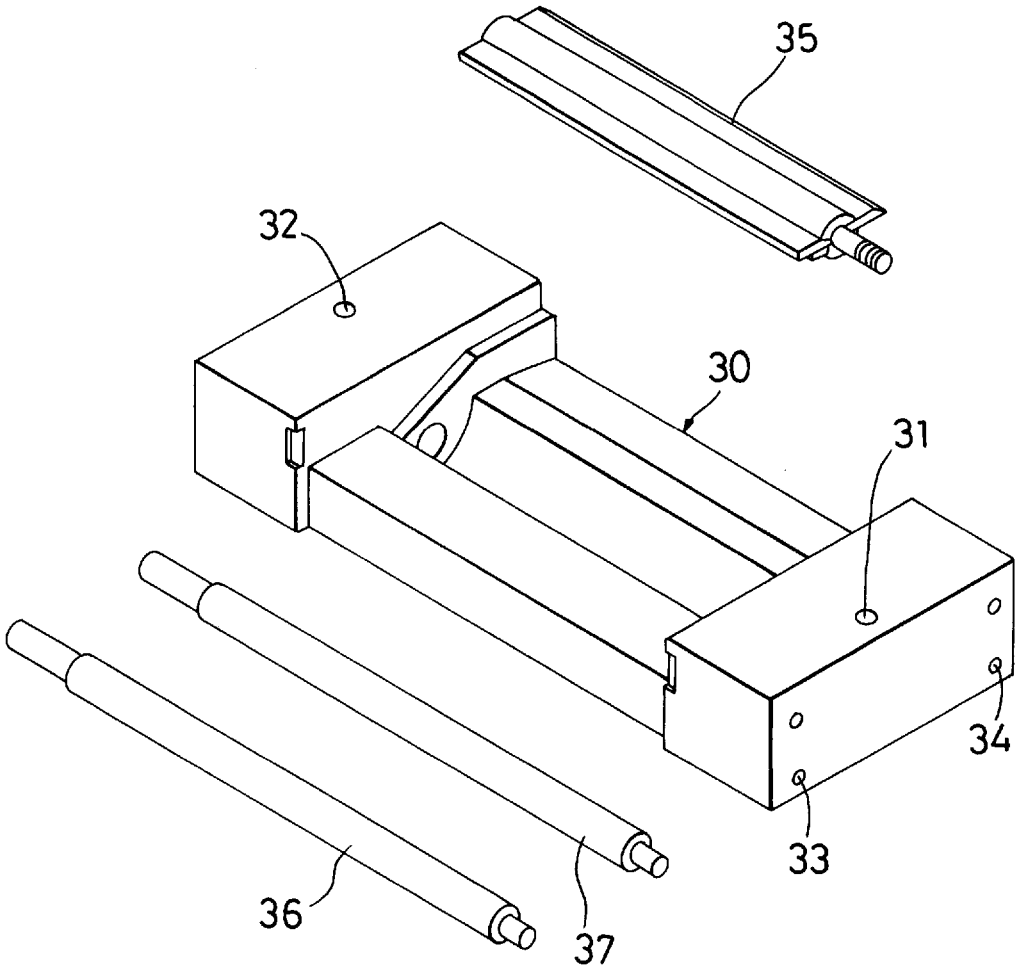
FIG. 4 is an exploded perspective view illustrating an upper housing and cutting and feed rollers of the preferred embodiment.

Referring to FIGS. 3 and 4, the preferred embodiment of a wood planing machine according to the present invention is shown to comprise a machine base 20 and an upper housing 30. The machine base 20 has a bed 200 over which a wooden work piece (not shown) passes, and a pair of vertical side walls 21, 22 mounted on opposite end portions of the bed 200. The upper housing 30 is disposed between the side walls 21, 22 above the bed 200. A cutting roller 35 is mounted on the upper housing 30 and is rotatable about a horizontal axis. Front and rear feed rollers 36, 37 are similarly mounted on front and rear portions of the upper housing 30 and are rotatable about axes parallel to the cutting roller 35. A motor 40 is mounted on the upper housing 30 and is coupled to one end of the cutting roller 35 in a known manner so as to drive rotatably the same. The other end of the cutting roller 35 is coupled to the feed rollers 36, 37 in a conventional manner such that the feed rollers 36, 37 rotate simultaneously with the cutting roller 35.

The upper housing 30 has opposite end portions formed with a pair of vertically extending screw holes 31, 32. The machine base 20 has a pair of upright threaded rods 50 (only one is shown) mounted rotatably on the opposite end portions of the bed 200 and extending threadedly and respectively through the screw holes 31, 32. An adjusting unit 60 is provided on the side wall 21 and is coupled to the threaded rods 50. The adjusting unit 60 is operable so as to rotate the threaded rods 50 simultaneously on the bed 200 in a conventional manner.

The side walls 21, 22 are formed with front and rear pairs of aligned vertically extending slots 211, 221, 212, 222. The front and rear portions of the upper housing 30 are formed with front and rear horizontal bores 33, 34 that extend between the side walls 21, 22 and that are aligned respectively with a corresponding one of the front and rear pairs of aligned vertically extending slots 211, 221, 212, 222.

Figure 5:
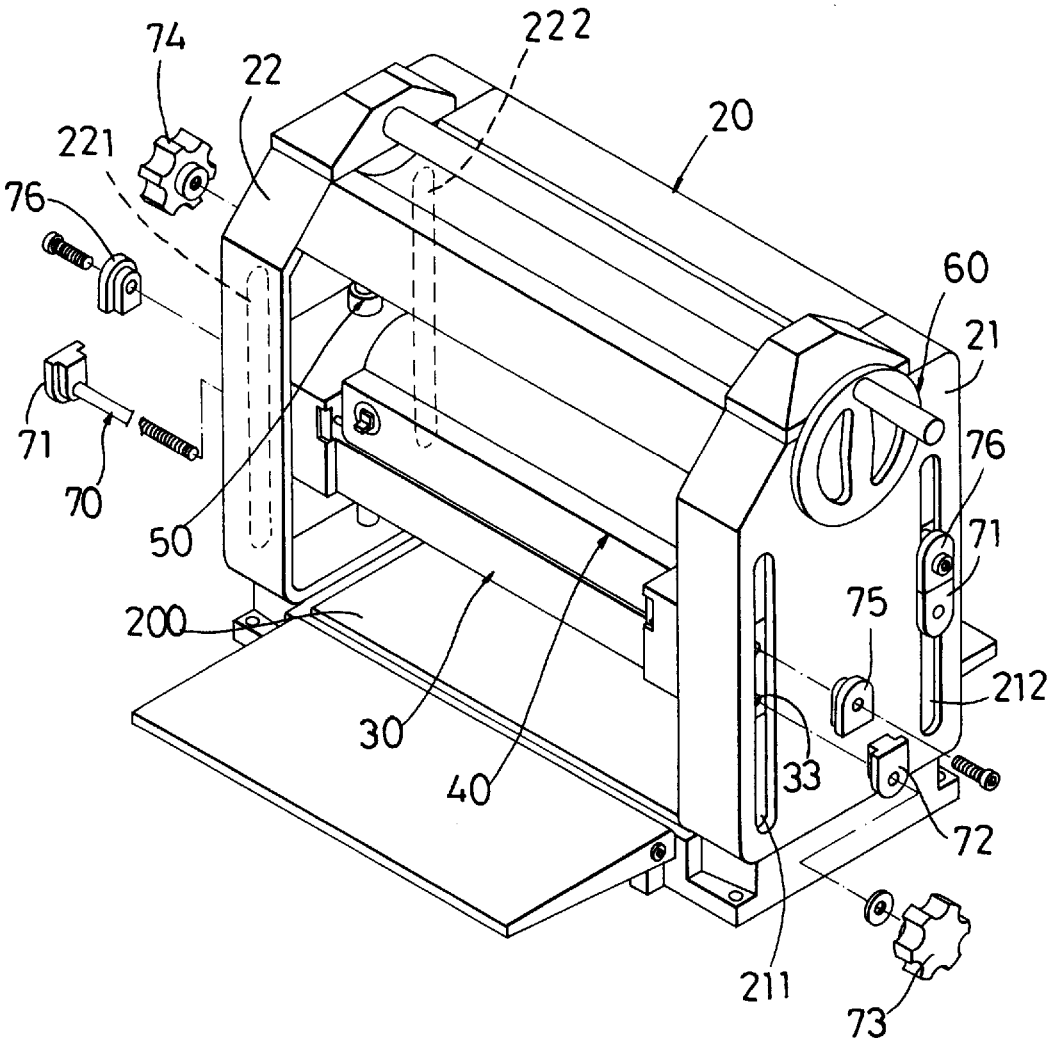
FIG. 5 is a partly exploded perspective view of the preferred embodiment.

Referring to FIG. 5, each of a pair of horizontal mounting shafts 70 is received in a respective one of the bores 33, 34 and has opposite first and second end portions which extend respectively toward the corresponding one of the slots 211, 221, 212, 222. The first end portion of each mounting shaft 70 has a first slide piece 71 mounted fixedly thereon, and the second end portion of the same has a second slide piece 72 mounted removably thereon. The slide pieces 71, 72 engage slidably the slots 211, 221, 212, 222 to mount slidably the upper housing 30 on the side walls 21, 22 and guide movement of the upper housing 30 relative to the bed 200 when the adjusting unit 60 is operated so as to rotate the threaded rods 50. The second end portion of each mounting shaft 70 is formed with an external screw thread and is provided with an internally threaded locking knob 73, 74 for forcing the second slide pieces 72 against one of the side walls 21, 22 to lock the upper housing 30 at a desired height relative to the bed 200. Preferably, each of the side walls 21, 22 has an outer surface provided with a pair of auxiliary slide pieces 75, 76 which engage slidably and respectively a corresponding one of the slots 211, 212, 221, 222 and which are secured to the upper housing 30 by means of screw fasteners to further ensure stable movement of the upper housing 30 relative to the bed 200.

To adjust the height of the cutting roller 35 (see FIG. 4) in accordance with the desired thickness of the finished product, the locking knobs 73, 74 are loosened, and the adjusting unit 60 is then operated so as to rotate the threaded rods 50. As such, the upper housing 30 can be raised or lowered to a desired position relative to the bed 200. When the cutting roller 35 is at the desired height, the locking knobs 73, 74 are tightened anew to lock the upper housing 30 on the side walls 21, 22 at the adjusted position.

The advantages of the wood planing machine of the present invention are as follows:

1. Since the mounting shafts 70, the locking knobs 73, 74 and the slide pieces 71, 72 can lock the upper housing 30 onto the side walls 21, 22 when the wood planing machine is in operation, the forces which are applied on the upper housing 30 can be transmitted to the side walls 21, 22, thereby reducing the forces which are transmitted to the threaded engagement between the threaded rods 50 and the upper housing 30 to minimize the possibility of damage to the screw threads on the threaded rods 50 or in the screw holes 31, 32.
2. Since the upper housing 30 can be locked firmly and securely onto the side walls 21, 22 when the wood planing machine is in operation, the presence of uneven lateral forces will not result in damage to the mounting shafts 70. As such, unhindered future adjustment of the height of the cutting roller 35 can be ensured.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wood planing machine comprising:

a machine base having a bed with opposite end portions, a pair of upright threaded rods mounted rotatably on said opposite end portions of said bed, and a pair of vertical side walls mounted on said opposite end portions of said bed, said side walls being formed with front and rear pairs of aligned vertically extending slots;

an upper housing disposed between said side walls above said bed, said upper housing having front and rear portions provided respectively with an opposite pair of slide pieces which engage a corresponding one of said front and rear pairs of vertically extending slots to mount slidably said upper housing on said side walls, said upper housing further having opposite end portions formed with a pair of vertically extending screw holes, said threaded rods extending threadedly and respectively through said screw holes and being rotatable on said bed so as to raise or lower said upper housing to a desired position relative to said bed; and cutting and feed rollers mounted rotatably on said upper housing and rotatable about parallel horizontal axes.

2. The wood planing machine of claim 1, wherein said front and rear portions of said upper housing are formed with a respective horizontal bore therethrough which receives a respective horizontal mounting shaft that is aligned with a corresponding one of said front and rear pairs of vertically extending slots, said mounting shaft having opposite first and second end portions which extend respectively toward the corresponding one of said slots and which has a respective one of said slide pieces provided thereon.

3. The wood planing machine of claim 2, wherein said slide piece on said first end portion of said mounting shaft is mounted fixedly thereon, and said slide piece on said second end portion of said mounting shaft is mounted removably thereon.

4. The wood planing machine of claim 3, wherein said second end portion of said mounting shaft is formed with an external screw thread and is provided with an internally threaded locking knob for forcing said slide piece thereon against one of said side walls to lock said upper housing at the desired position on said side walls.

5. The wood planing machine of claim 1, wherein each of said side walls has an outer surface provided with a pair of auxiliary slide pieces which engage slidably and respectively a corresponding one of said slots, and which are secured to said upper housing.

* * * * *